US006752048B1

(12) United States Patent
Chiang

(10) Patent No.: US 6,752,048 B1
(45) Date of Patent: Jun. 22, 2004

(54) QUICK ROTATION WRENCH HAVING AN ANGLE ADJUSTMENT STRUCTURE

(76) Inventor: Shui-Lai Chiang, 58, Ma Yuan West St., Taichung (TW)

( * ) Notice: Subject to any disclaimer, the term of this patent is extended or adjusted under 35 U.S.C. 154(b) by 38 days.

(21) Appl. No.: 10/314,733

(22) Filed: Dec. 6, 2002

(51) Int. Cl.[7] ..... B25B 13/64

(52) U.S. Cl. ..... 81/63.1; 81/63.2; 81/58; 81/61; 81/62; 81/177.7; 81/177.75; 81/177.8

(58) Field of Search ..... 81/58, 61, 62, 81/63.1, 63.2, 177.7, 177.75, 177.8, 177.9

(56) References Cited

U.S. PATENT DOCUMENTS 3,467,231 A * 9/1969 Haznar ..... 192/43.1
3,532,013 A * 10/1970 Haznar ..... 81/62
5,419,221 A * 5/1995 Cole ..... 81/60
5,537,899 A * 7/1996 Diedrich ..... 81/57.39
6,032,555 A * 3/2000 Whitley ..... 81/63.1
6,216,565 B1 * 4/2001 McCann ..... 81/177.8
6,457,386 B1 * 10/2002 Chiang ..... 81/62

* cited by examiner

*Primary Examiner*—Lee D. Wilson
*Assistant Examiner*—Alvin J. Grant

(57) ABSTRACT

A quick rotation wrench includes a driving portion, a wrench body, and an angle adjustment structure. The angle adjustment structure includes a control knob, two pawl members, two positioning members, and an elastic member. Thus, the included angle between the wrench body and the driving portion can be adjusted freely and arbitrarily. In addition, the included angle between the wrench body and the driving portion can be adjusted easily and conveniently. Further, the control knob is mounted on the wrench body, so that the user can use his one hand to press the control knob and operate the wrench body easily and conveniently, thereby facilitating the user operating the quick rotation wrench.

11 Claims, 14 Drawing Sheets

QUICK ROTATION WRENCH HAVING AN ANGLE ADJUSTMENT STRUCTURE

BACKGROUND OF THE INVENTION

1. Field of the Invention

The present invention relates to a quick rotation wrench having an angle adjustment structure, and more particularly to a quick rotation wrench having an angle adjustment structure, wherein the included angle between the wrench body and the driving portion can be adjusted freely and arbitrarily.

2. Description of the Related Art

A first conventional quick rotation wrench 1 in accordance with the prior art shown in FIGS. 1 and 2 comprises a driving portion 10, a wrench body 16, and a fixing shaft 13. The driving portion 10 is formed with a combination recess 11 and a riveting hole 12. The wrench body 16 is rotatably mounted on the driving portion 10 and is formed with a shaft hole 17. The wrench body 16 has a flat end 161. The fixing shaft 13 is mounted in the shaft hole 17 of the wrench body 16 and has a top formed with an enlarged head 14 and a bottom formed with a riveting end 15 riveted in the riveting hole 12 of the driving portion 10. An elastic member 18 and a positioning ball 19 are embedded in the fixing shaft 13. Thus, the wrench body 16 can be rotated on the driving portion 10, and can be fixed on the driving portion 10. However, the fixed angle between the wrench body 16 and the driving portion 10 only has five values as shown in FIG. 2, so that the first conventional quick rotation wrench 1 cannot satisfy the user's requirement.

A second conventional quick rotation wrench 2 in accordance with the prior art shown in FIGS. 3 and 4 comprises a driving portion 20, a wrench body 26, and a fixing shaft 23. The driving portion 20 is formed with a combination recess 21 and a riveting hole 22. The wrench body 26 is rotatably mounted on the driving portion 20 and is formed with a shaft hole 27 and inner teeth 271. The wrench body 26 has a semi-circular end 261. The fixing shaft 23 is mounted in the shaft hole 27 of the wrench body 26 and has outer teeth 231 engaged with the inner teeth 271 of the wrench body 26. The fixing shaft 23 has a top formed with an enlarged head 24 and a bottom formed with a riveting end 25 riveted in the riveting hole 22 of the driving portion 20. An elastic member 28 and a positioning ball 29 are embedded in the fixing shaft 23. Thus, the wrench body 26 can be rotated on the driving portion 20, and can be fixed on the driving portion 20. However, the fixed angle between the wrench body 26 and the driving portion 20 is limited in the range of 180 degrees as shown in FIG. 4, so that the second conventional quick rotation wrench 2 cannot satisfy the user's requirement.

SUMMARY OF THE INVENTION

The present invention has arisen to mitigate and/or obviate the disadvantage of the conventional quick rotation wrench.

The primary objective of the present invention is to provide a quick rotation wrench having an angle adjustment structure, wherein the included angle between the wrench body and the driving portion can be adjusted freely and arbitrarily.

Another objective of the present invention is to provide a quick rotation wrench having an angle adjustment structure, wherein the included angle between the wrench body and the driving portion can be adjusted easily and conveniently.

A further objective of the present invention is to provide a quick rotation wrench having an angle adjustment structure, wherein the control knob is mounted on the wrench body, so that the user can use his one hand to press the control knob and operate the wrench body easily and conveniently, thereby facilitating the user operating the quick rotation wrench.

In accordance with the present invention, there is provided a quick rotation wrench having an angle adjustment structure, comprising a driving portion, a wrench body, and an angle adjustment structure, wherein:

the driving portion has an inner wall formed with a shaft hole and a plurality of ratchet teeth;

the wrench body is rotatably mounted on the driving portion and has a shaft seat rotatably mounted in the shaft hole of the driving portion, the shaft seat of the wrench body has two opposite sides each formed with a receiving recess and a top formed with a receiving chamber communicating with the receiving recess; and the angle adjustment structure is mounted on the shaft seat of the wrench body and includes two pawl members, and a control knob, wherein:

each of the two pawl members is pivotally mounted in the respective receiving recess of the shaft seat of the wrench body, each of the two pawl members has a first end formed with a plurality of locking teeth engageable with the ratchet teeth of the driving portion and a second end formed with a smooth face; and the control knob is pivotally mounted in the receiving chamber of the shaft seat of the wrench body, and has a bottom formed with a protruding driving portion rested on an inner side of each of the two pawl members to urge and pivot each of the two pawl members.

Further benefits and advantages of the present invention will become apparent after a careful reading of the detailed description with appropriate reference to the accompanying drawings.

DETAILED DESCRIPTION OF THE INVENTION

Figure 1:
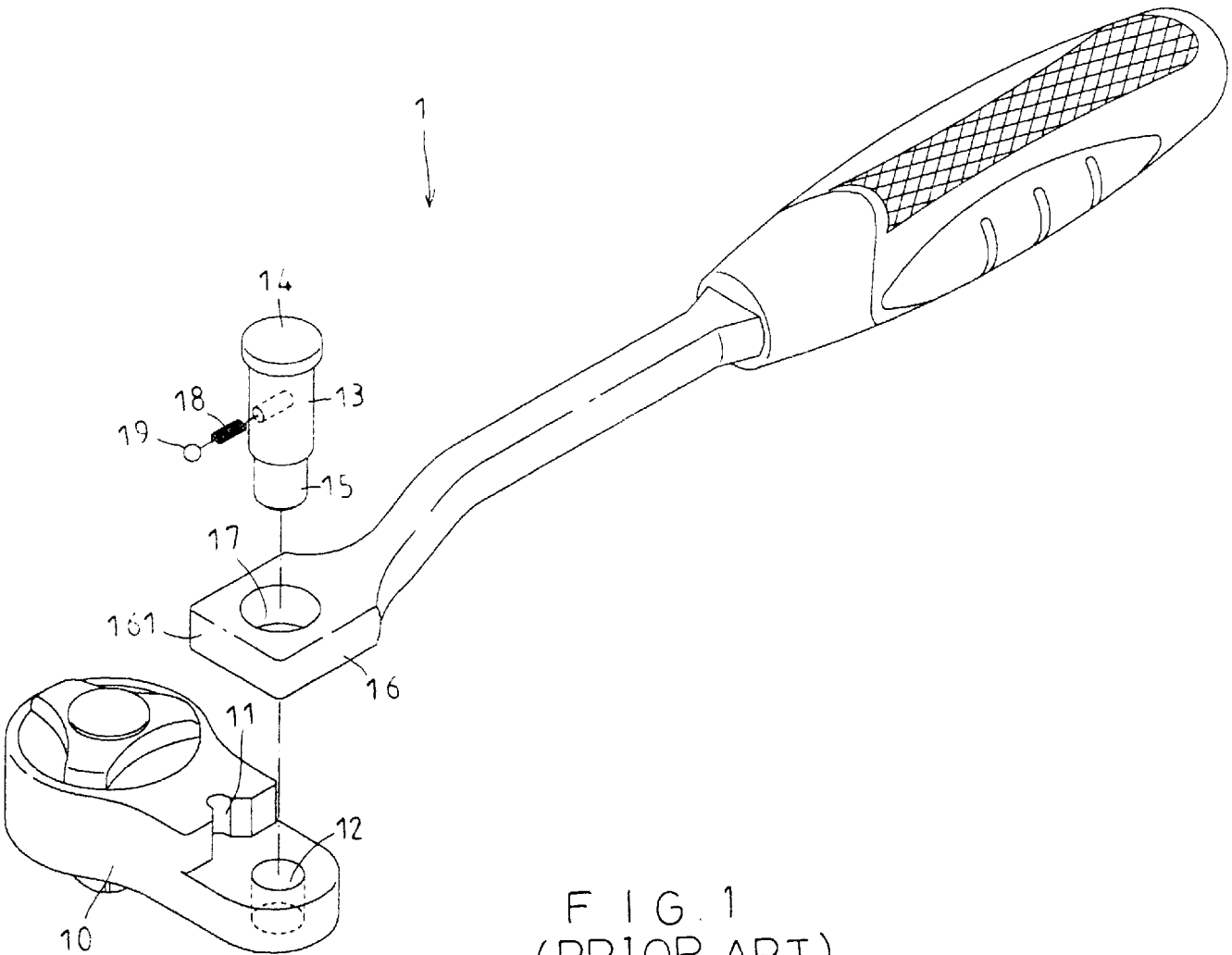
FIG. 1 (PRIOR ART)
FIG. 1 is an exploded perspective view of a first conventional quick rotation wrench in accordance with the prior art.
Figure 2:
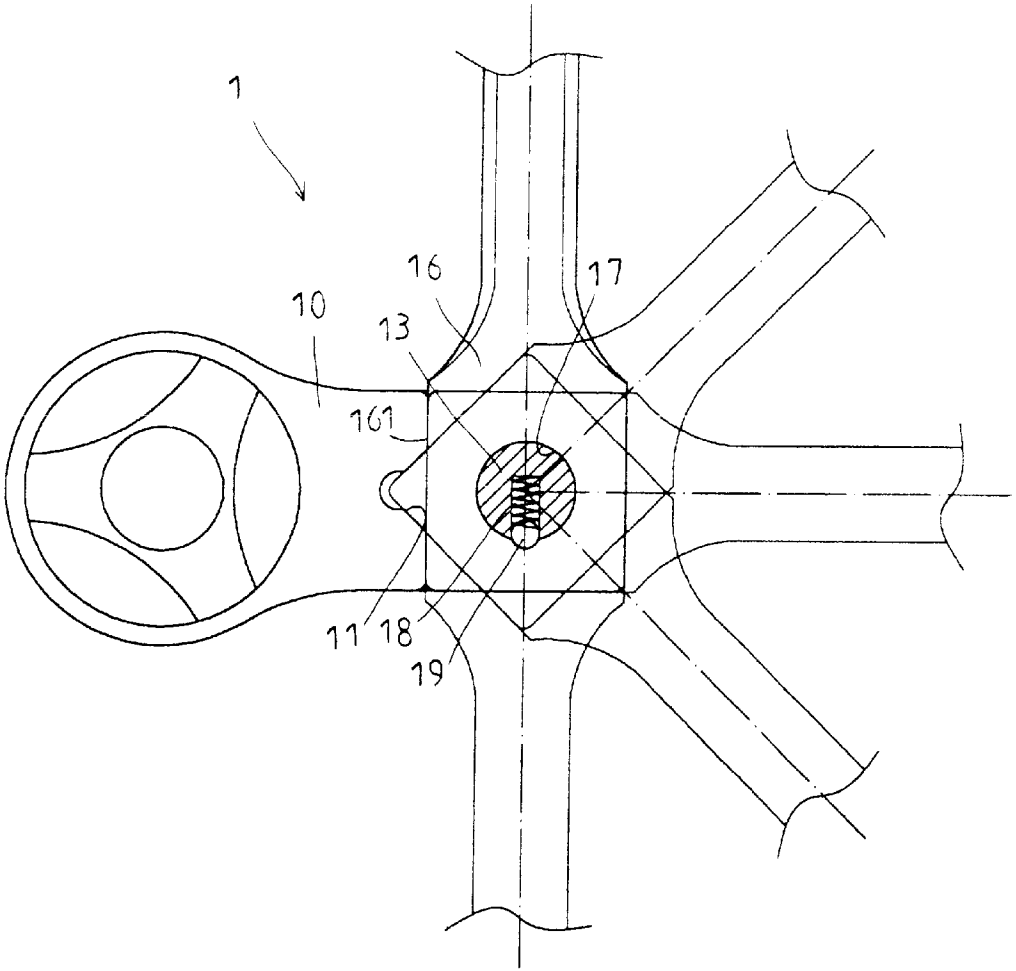
FIG. 2 (PRIOR ART)
FIG. 2 is a top plan cross-sectional assembly operational view of the first conventional quick rotation wrench as shown in FIG. 1.
Figure 3:
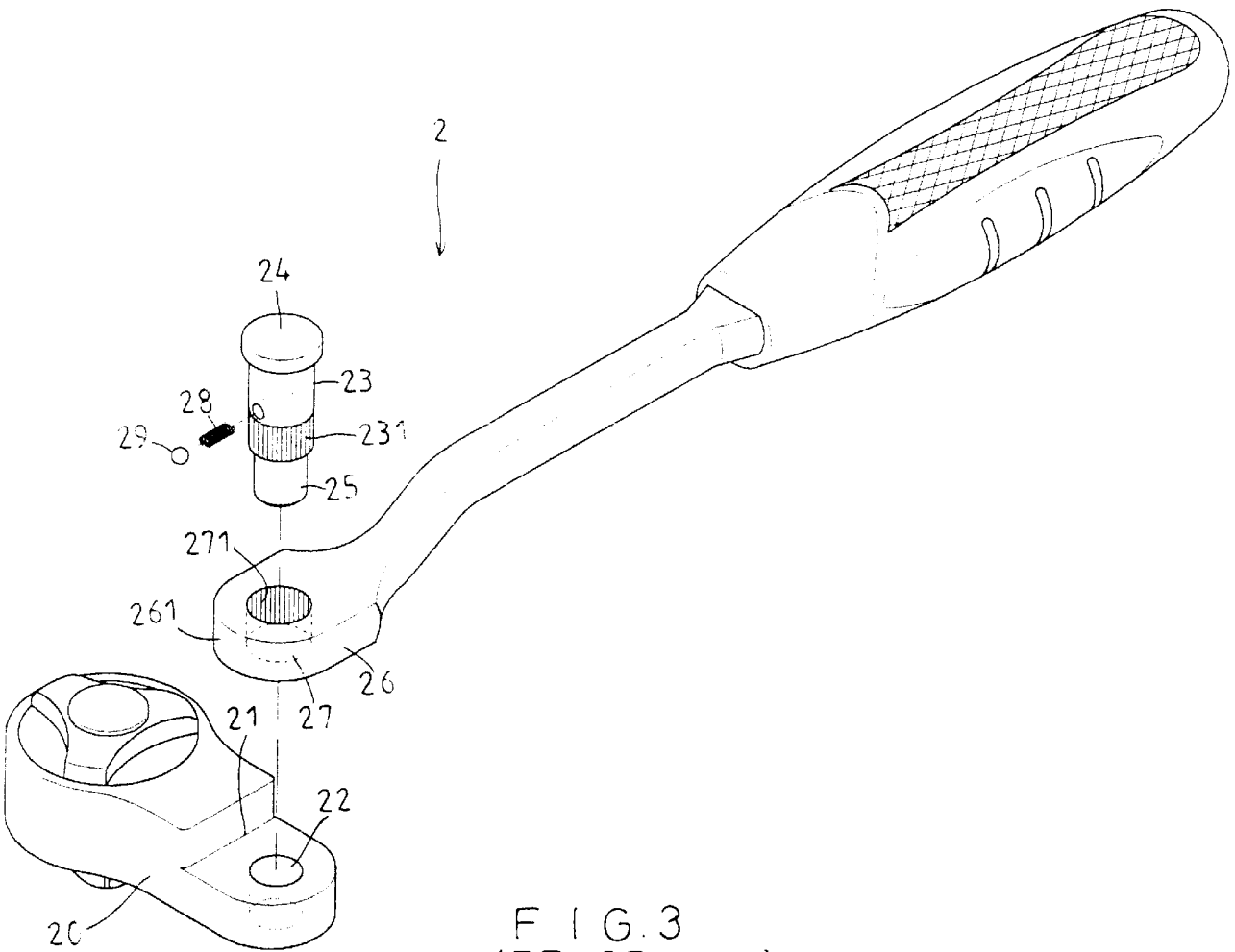
FIG. 3 (PRIOR ART)
FIG. 3 is an exploded perspective view of a second conventional quick rotation wrench in accordance with the prior art.
Figure 4:
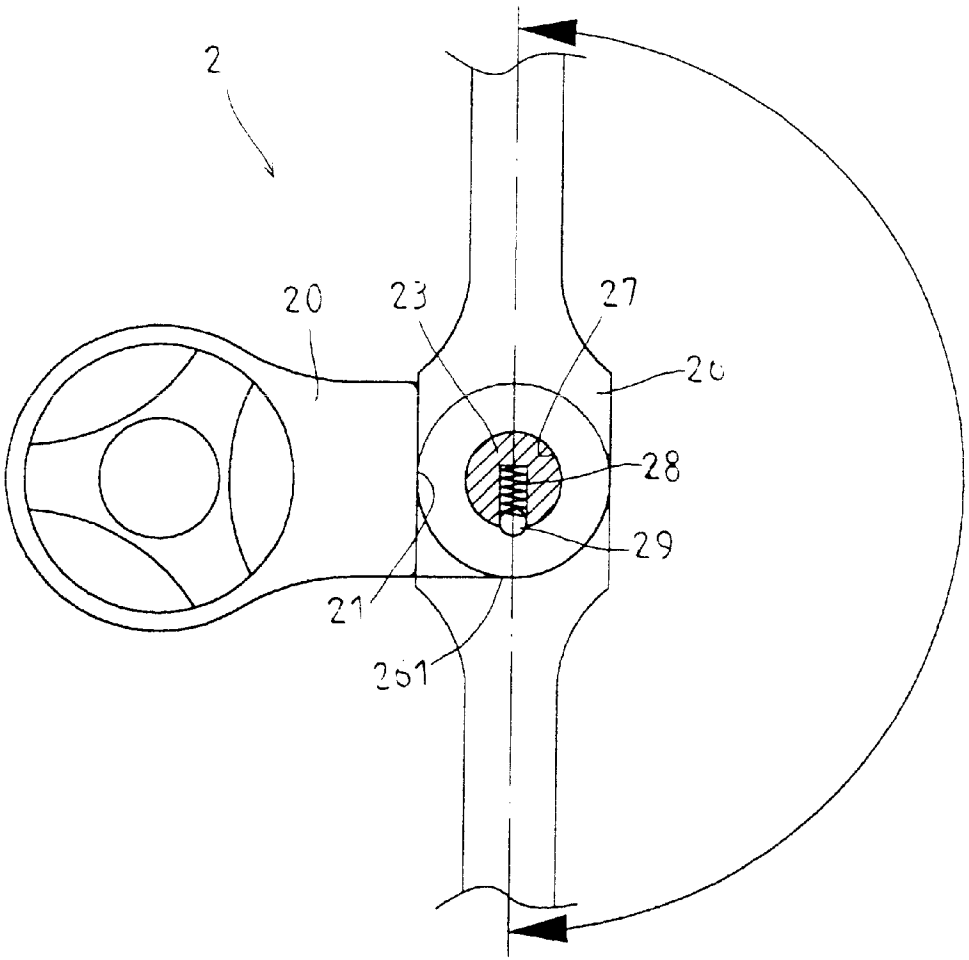
FIG. 4 (PRIOR ART)
FIG. 4 is a top plan cross-sectional assembly operational view of the second conventional quick rotation wrench as shown in FIG. 3.
Figure 5:
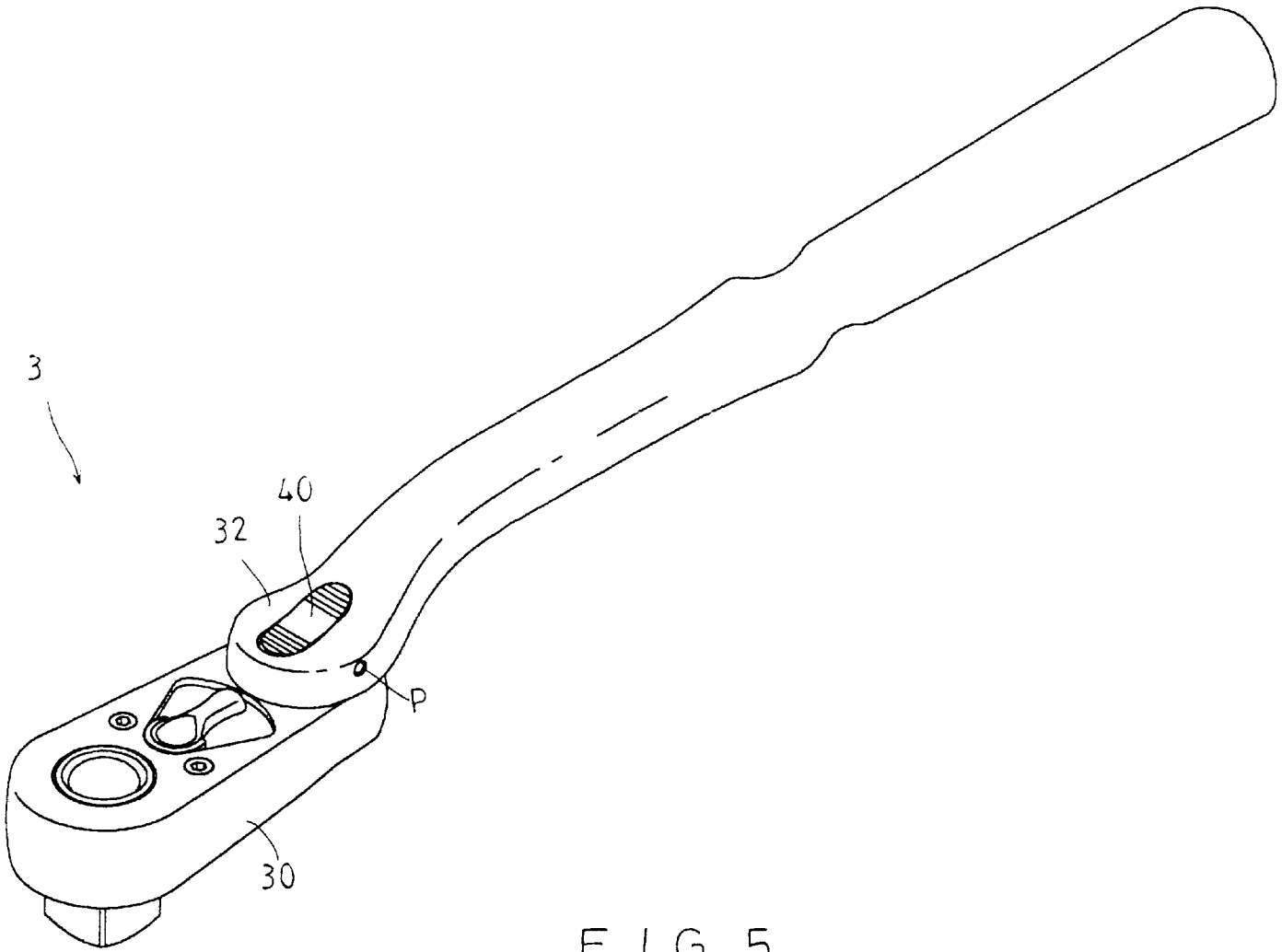
FIG. 5 is a perspective view of a quick rotation wrench having an angle adjustment structure in accordance with a first embodiment of the present invention.

Referring to the drawings and initially to FIGS. 5–9, a quick rotation wrench 3 having an angle adjustment structure in accordance with a first embodiment of the present invention comprises a driving portion 30, a wrench body 32, and an angle adjustment structure 4.

The driving portion 30 has an inner wall formed with a shaft hole 31 and a plurality of ratchet teeth 34.

The wrench body 32 is rotatably mounted on the driving portion 30 and has one end formed with a shaft seat 33 rotatably mounted in the shaft hole 31 of the driving portion 30. The shaft seat 33 of the wrench body 32 has a bottom formed with an annular groove 38 for securing a C-shaped snap ring 39 which is rested on a bottom of the driving portion 30, thereby combining the shaft seat 33 of the wrench body 32 with the driving portion 30 integrally. The shaft seat 33 of the wrench body 32 has two opposite sides each formed with a receiving recess 36 and a top formed with a receiving chamber 35 communicating with the receiving recess 36.

The angle adjustment structure 4 is mounted on the shaft seat 33 of the wrench body 32 and includes a control knob 40, two pawl members 43, two positioning members 41, and an elastic member 42.

The control knob 40 is pivotally mounted in the receiving chamber 35 of the shaft seat 33 of the wrench body 32 by a pivot pin 402 which is extended through the shaft seat 33 of the wrench body 32 and the control knob 40. The control knob 40 has a bottom formed with a protruding cone-shaped driving portion 401 which is formed with a receiving hole 403. An urging member 37 is mounted in the receiving chamber 35 of the shaft seat 33 of the wrench body 32, and is urged on the bottom of the driving portion 401 of the control knob 40. An elastic member 370 is mounted in the receiving chamber 35 of the shaft seat 33 of the wrench body 32, and is urged between a wall of the receiving chamber 35 of the shaft seat 33 of the wrench body 32 and the urging member 37.

Each of the two pawl members 43 is pivotally mounted in the receiving recess 36 of the shaft seat 33 of the wrench body 32 by a pivot pin 435 which is extended through the shaft seat 33 of the wrench body 32 and the pawl member 43. Each of the two pawl members 43 has an inner side formed with a positioning cavity 431. Each of the two pawl members 43 has a first end formed with a plurality of locking teeth 432 engageable with the ratchet teeth 34 of the driving portion 30 and a second end formed with a smooth face 433.

Each of the two positioning members 41 is mounted in the receiving hole 403 of the driving portion 401 of the control knob 40 and is urged in the positioning cavity 431 of a respective one of the two pawl members 43.

The elastic member 42 is mounted in the receiving hole 403 of the driving portion 401 of the control knob 40 and is urged between the two positioning members 41.

Figure 6:
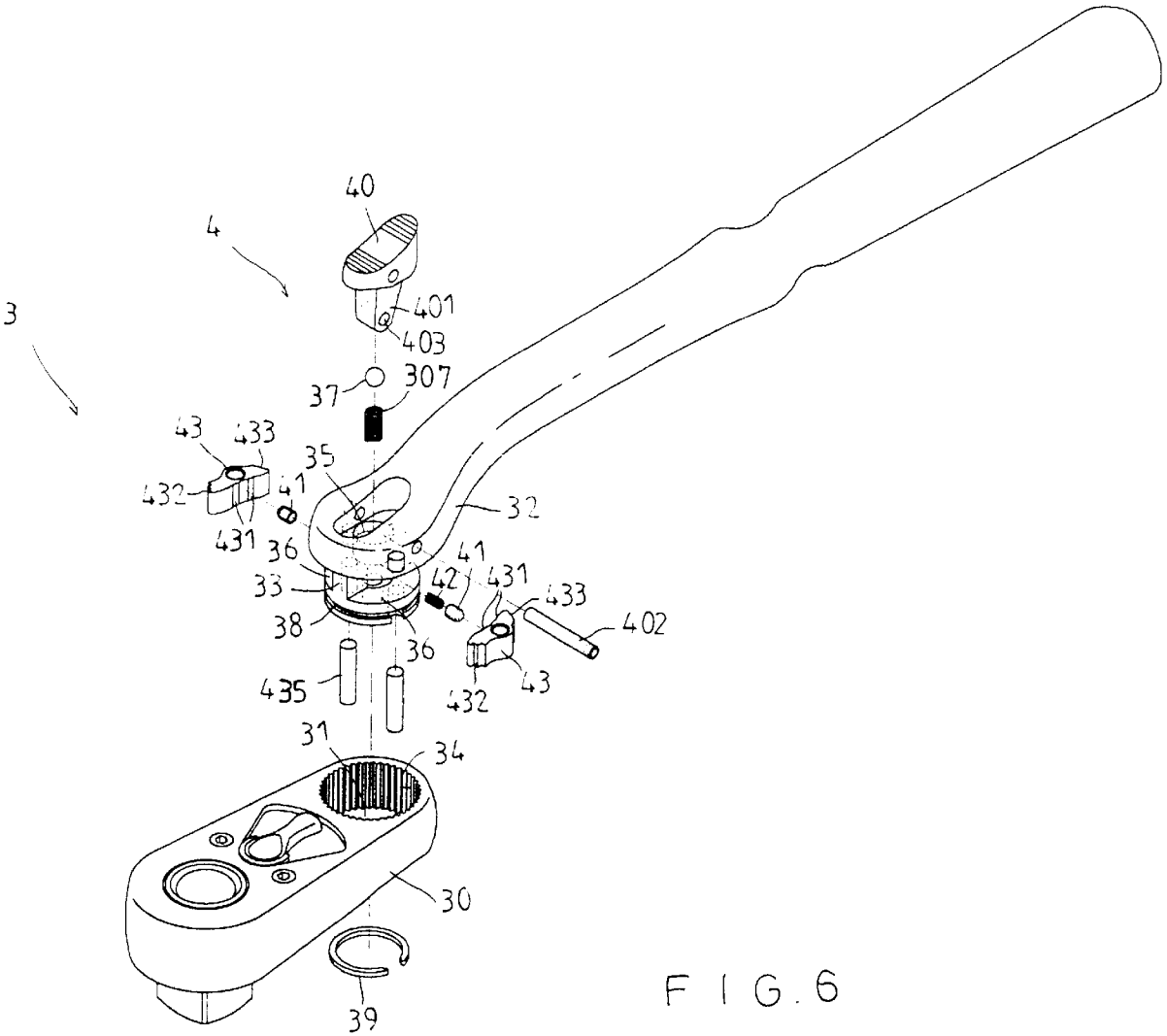
FIG. 6 is an exploded perspective view of the quick rotation wrench having an angle adjustment structure as shown in FIG. 5.
Figure 7:
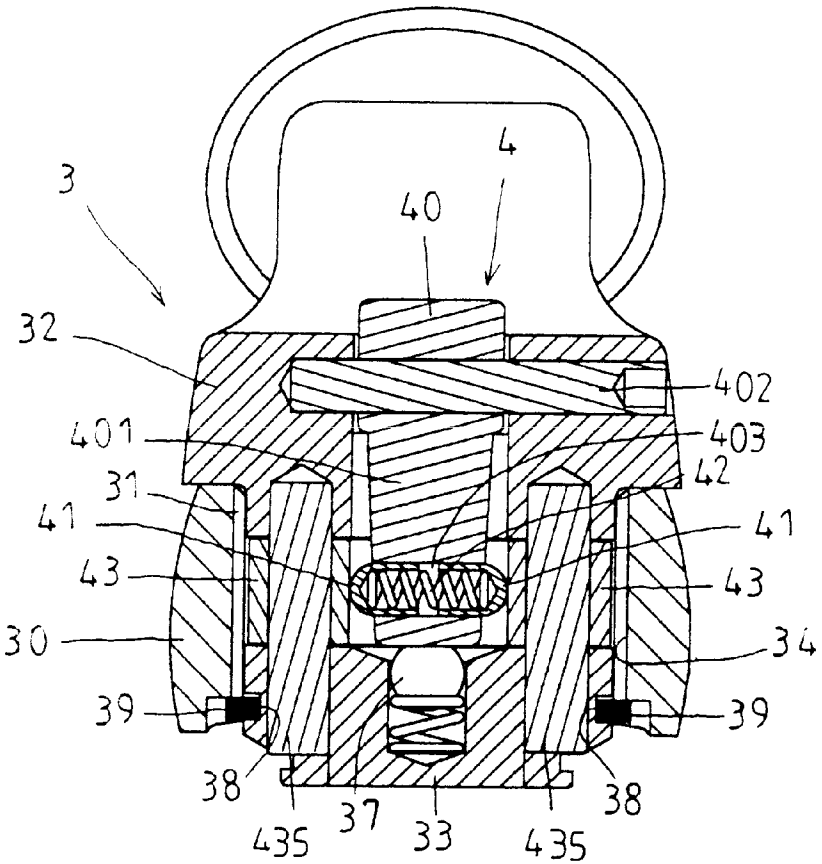
FIG. 7 is a side plan cross-sectional view of the quick rotation wrench having an angle adjustment structure as shown in FIG. 5.
Figure 8:
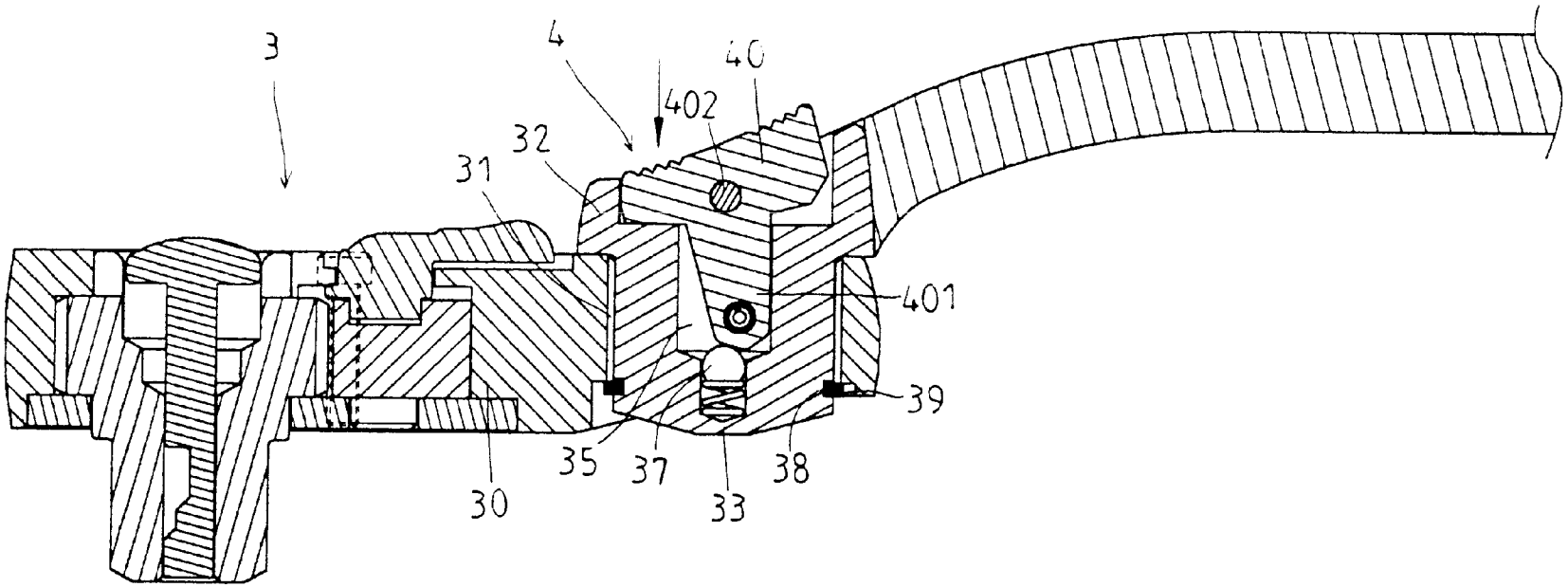
FIG. 8 is a front plan cross-sectional view of the quick rotation wrench having an angle adjustment structure as shown in FIG. 5.
Figure 9:
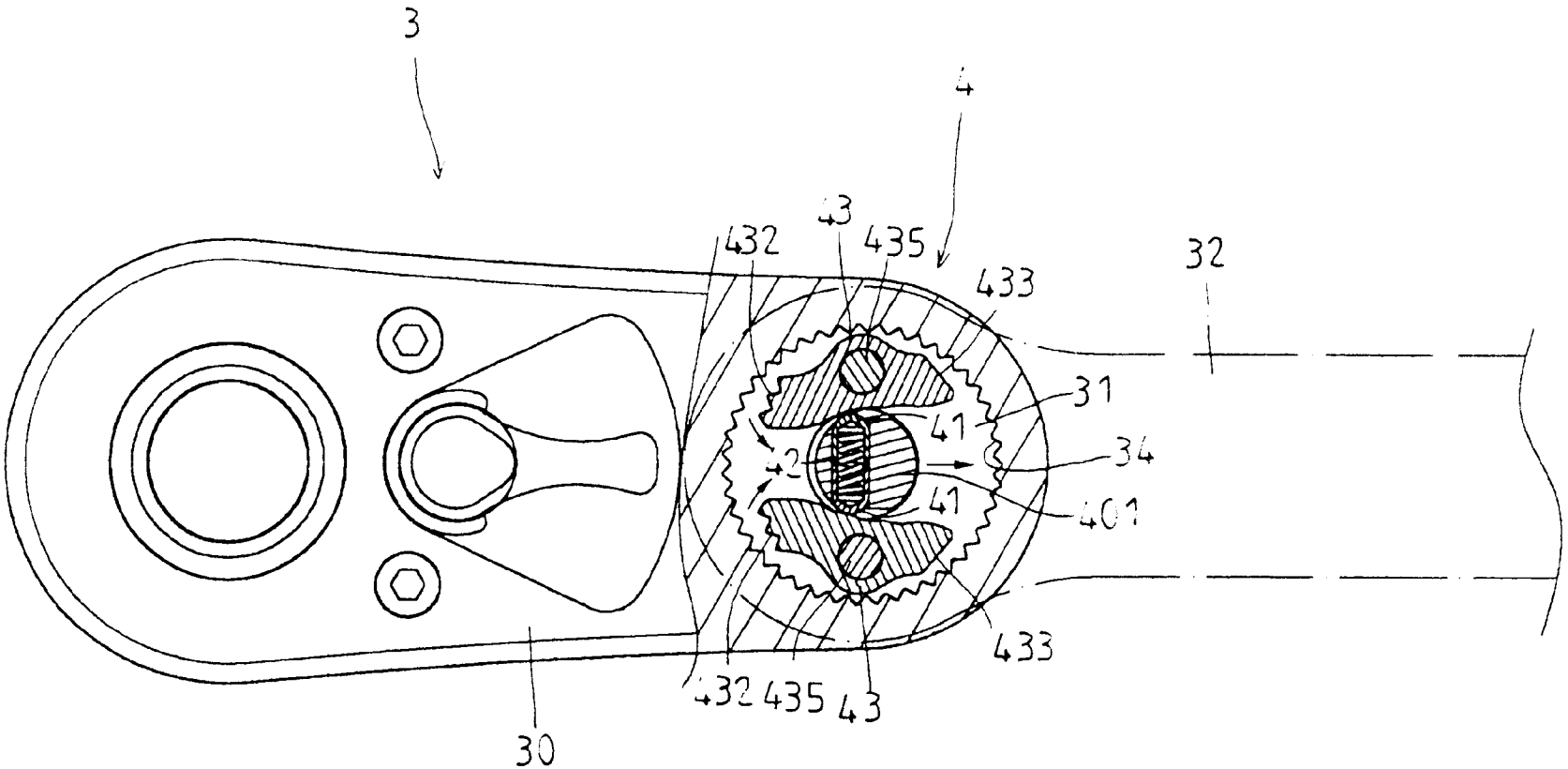
FIG. 9 is a top plan cross-sectional view of the quick rotation wrench having an angle adjustment structure as shown in FIG. 5.
Figure 10:
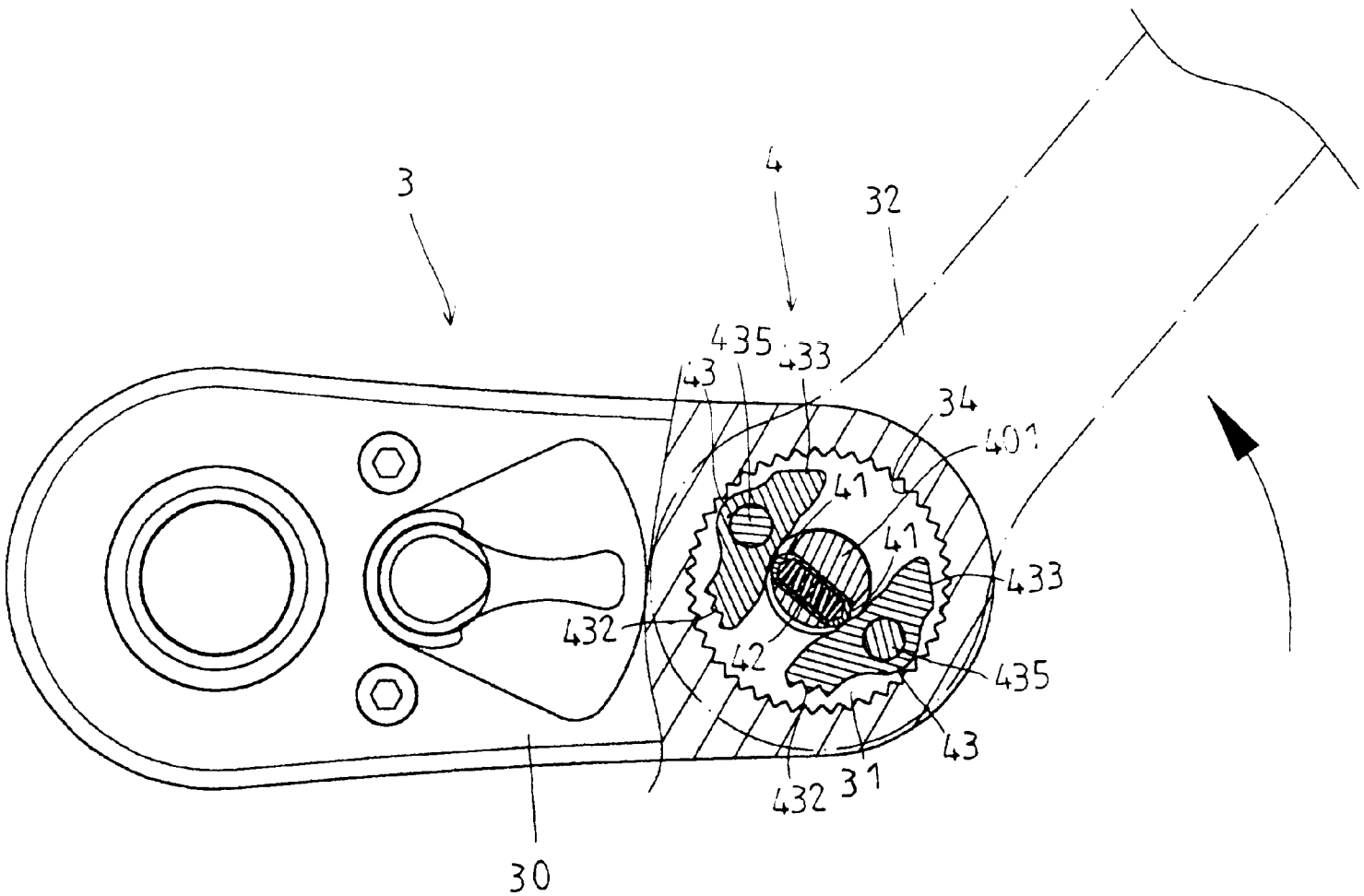
FIG. 10 is a schematic operational view of the quick rotation wrench having an angle adjustment structure as shown in FIG. 9.

In operation, referring to FIGS. 8–10 with reference to FIGS. 6 and 7, a first end of the control knob 40 is pressed downward as shown in FIG. 8, so that the driving portion 401 of the control knob 40 is moved to drive and move each of the two positioning members 41 to press the second end of each of the two pawl members 43, thereby moving the smooth face 433 of each of the two pawl members 43 toward the ratchet teeth 34 of the driving portion 30 as shown in FIG. 9. At this time, the smooth face 433 of each of the two pawl members 43 cannot engage the ratchet teeth 34 of the driving portion 30, so that the shaft seat 33 of the wrench body 32 is rotated on the driving portion 30 freely and rapidly as shown in FIG. 10, thereby forming the quick rotation state of the quick rotation wrench 3 in accordance with the present invention.

Figure 11:
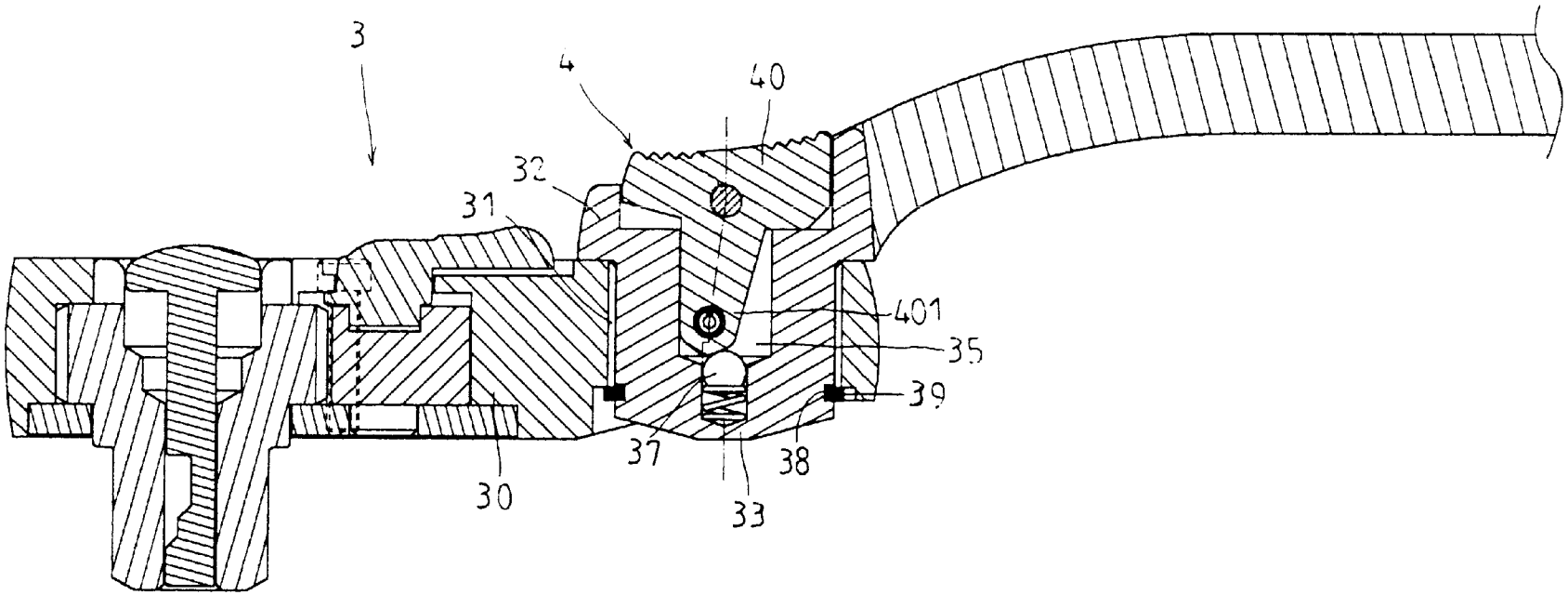
FIG. 11 is a front plan cross-sectional view of the quick rotation wrench having an angle adjustment structure as shown in FIG. 5.
Figure 12:
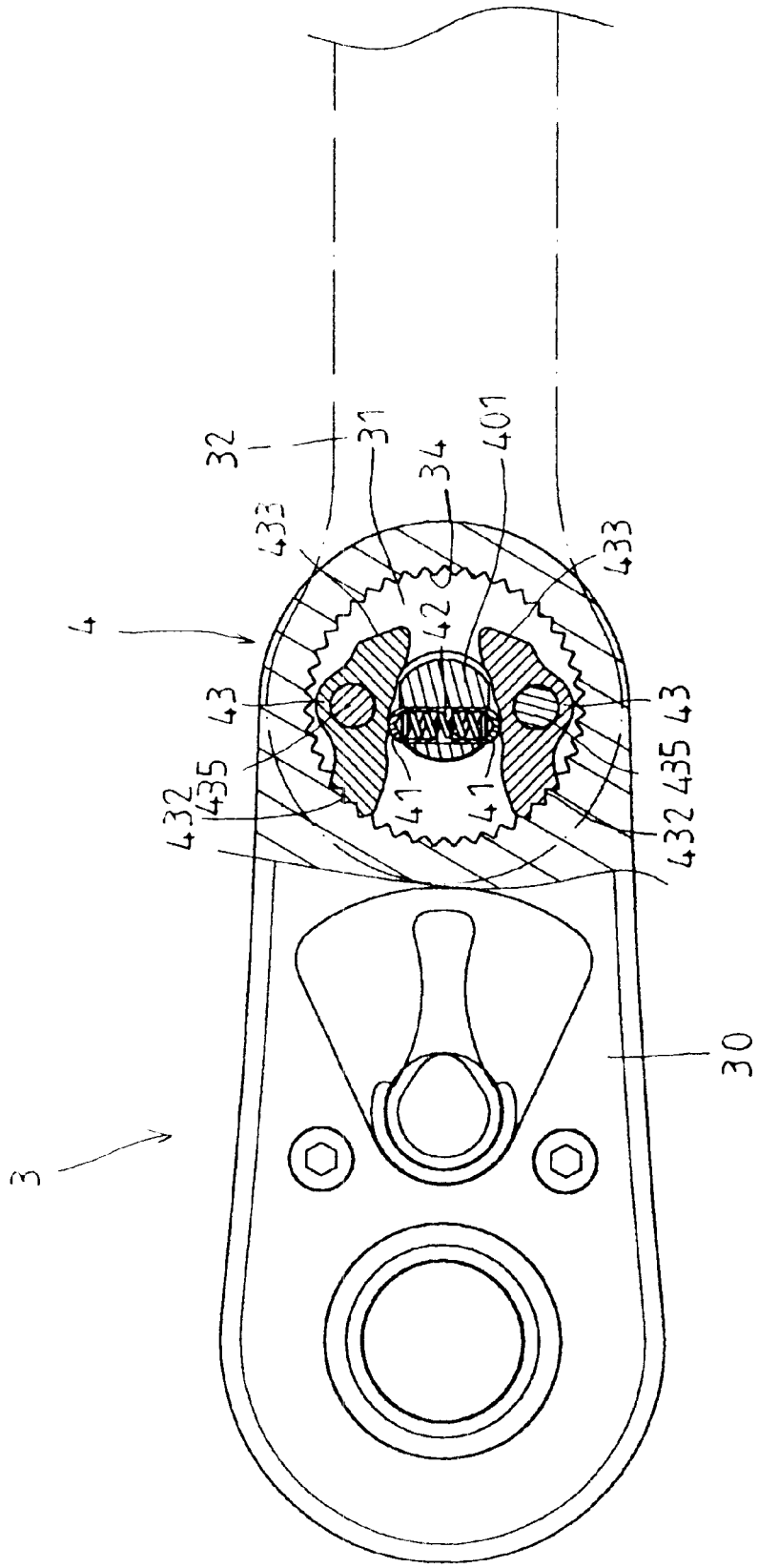
FIG. 12 is a top plan cross-sectional view of the quick rotation wrench having an angle adjustment structure as shown in FIG. 5.

Alternatively, referring to FIGS. 11 and 12 with reference to FIGS. 6 and 7, a second end of the control knob 40 is pressed downward as shown in FIG. 11, so that the driving portion 401 of the control knob 40 is moved to drive and move each of the two positioning members 41 to press the first end of each of the two pawl members 43, thereby moving the locking teeth 432 of each of the two pawl members 43 toward the ratchet teeth 34 of the driving portion 30 as shown in FIG. 12. At this time, the locking teeth 432 of each of the two pawl members 43 are engaged with the ratchet teeth 34 of the driving portion 30, so that the shaft seat 33 of the wrench body 32 is fixed on the driving portion 30 by the two pawl members 43 as shown in FIG. 12, thereby forming the fixing angle state of the quick rotation wrench 3 in accordance with the present invention. Thus, the included angle between the wrench body 32 and the driving portion 30 is fixed, so that the wrench body 32 co-operates with the driving portion 30 to operate a socket (not shown) or the like.

As shown in FIG. 12, the included angle between the wrench body 32 and the driving portion 30 is equal to zero.

Figure 13:
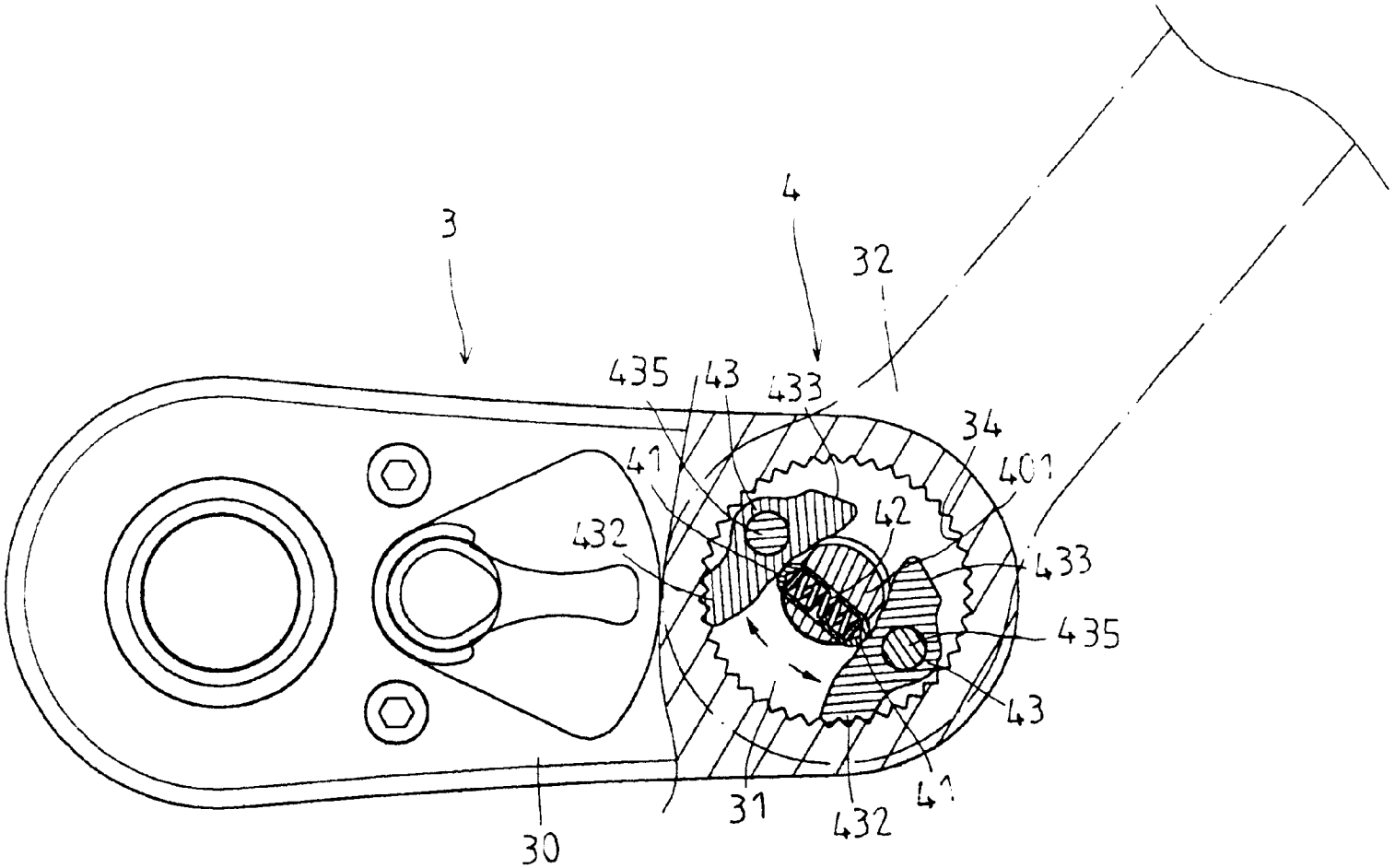
FIG. 13 is a schematic operational view of the quick rotation wrench having an angle adjustment structure as shown in FIG. 12.

As shown in FIG. 13, the included angle between the wrench body 32 and the driving portion 30 is equal to forty five degree.

Figures 14, 14A:
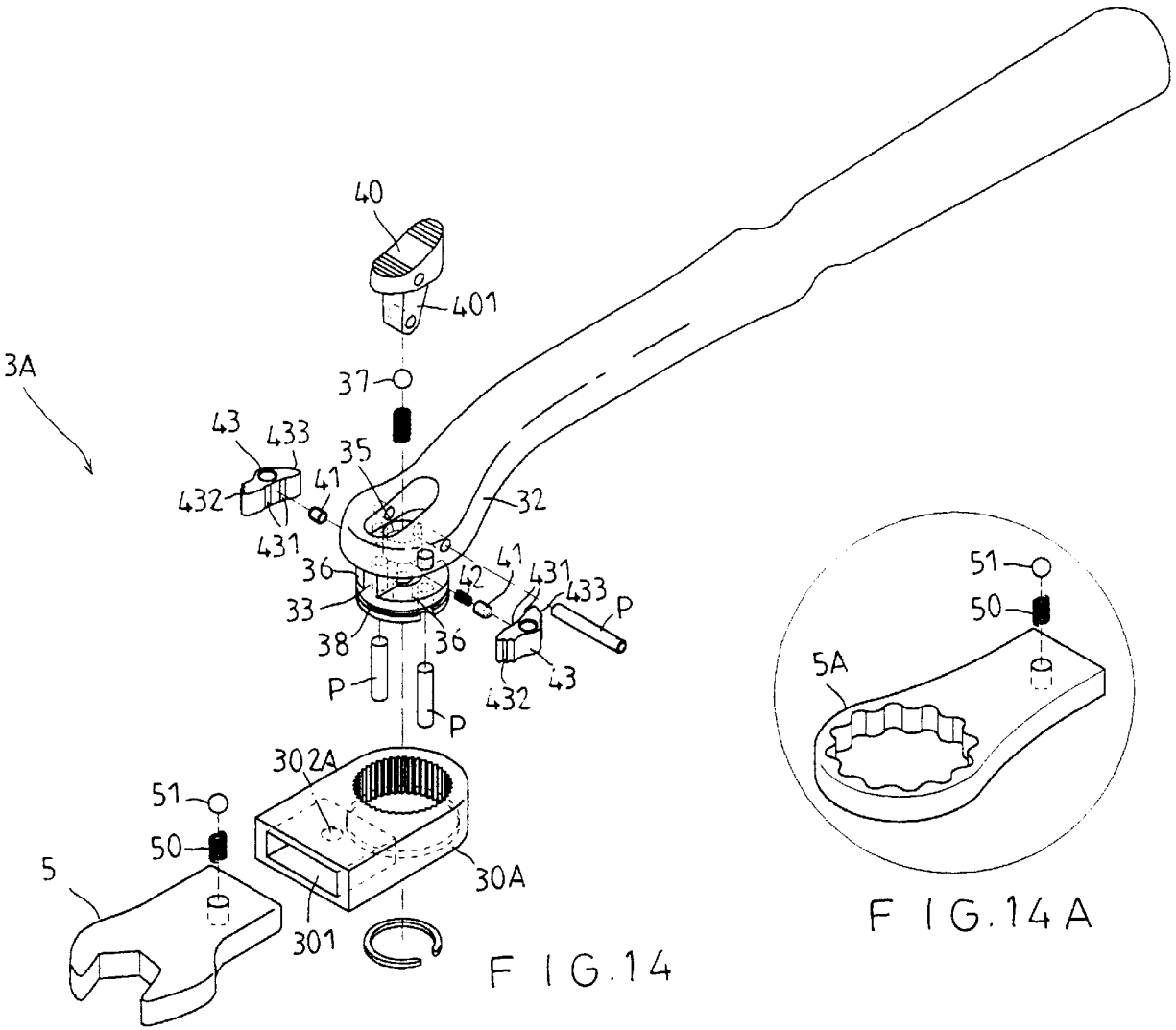
FIG. 14 is an exploded perspective view of a quick rotation wrench having an angle adjustment structure in accordance with a second embodiment of the present invention.
FIG. 14A is an exploded perspective view of a quick rotation wrench having an angle adjustment structure in accordance with another embodiment of the present invention.

Referring to FIGS. 14 and 14A, a quick rotation wrench 3A having an angle adjustment structure in accordance with a second embodiment of the present invention is shown, wherein the driving portion 30A is formed with an insertion recess 301 for insertion of an open-ended spanner 5 (or closed ended spanner 5A) and has a wall formed with a ball hole 302A communicating with the insertion recess 301 for receiving a positioning ball 51 and an elastic member 50 which is urged on the open-ended spanner 5 (or closed ended spanner 5A).

Accordingly, the control knob 40 is mounted on the wrench body 32, so that the user can use his one hand to press the control knob 40 and operate the wrench body 32 easily and conveniently, thereby facilitating the user operating the quick rotation wrench 3.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A quick rotation wrench having an angle adjustment structure, comprising a driving portion, a wrench body, and an angle adjustment structure, wherein:

the driving portion has an inner wall formed with a shaft hole and a plurality of ratchet teeth;

the wrench body is rotatably mounted on the driving portion and has a shaft seat rotatably mounted in the shaft hole of the driving portion, the shaft seat of the wrench body has two opposite sides each formed with a receiving recess and a top formed with a receiving chamber communicating with the receiving recess; and the angle adjustment structure is mounted on the shaft seat of the wrench body and includes two pawl members, and a control knob, wherein:

each of the two pawl members is pivotally mounted in the respective receiving recess of the shaft seat of the wrench body, each of the two pawl members has a first end formed with a plurality of locking teeth engageable with the ratchet teeth of the driving portion and a second end formed with a smooth face; and the control knob is pivotally mounted in the receiving chamber of the shaft seat of the wrench body, and has a bottom formed with a protruding driving portion rested on an inner side of each of the two pawl members to urge and pivot each of the two pawl members.

2. The quick rotation wrench having an angle adjustment structure in accordance with claim 1, wherein the shaft seat of the wrench body has a bottom formed with an annular groove for securing a C-shaped snap ring which is rested on a bottom of the driving portion, thereby combining the shaft seat of the wrench body with the driving portion integrally.

3. The quick rotation wrench having an angle adjustment structure in accordance with claim 1, wherein the control knob is pivotally mounted in the receiving chamber of the shaft seat of the wrench body by a pivot pin which is extended through the shaft seat of the wrench body and the control knob.

4. The quick rotation wrench having an angle adjustment structure in accordance with claim 1, wherein the protruding driving portion of the control knob is cone-shaped.

5. The quick rotation wrench having an angle adjustment structure in accordance with claim 1, wherein each of the two pawl members is pivotally mounted in the receiving recess of the shaft seat of the wrench body by a pivot pin which is extended through the shaft seat of the wrench body and the pawl member.

6. The quick rotation wrench having an angle adjustment structure in accordance with claim 1, wherein the protruding driving portion of the control knob has a bottom formed with a receiving hole, and the angle adjustment structure further includes two positioning members, and an elastic member, wherein:

each of the two positioning members is mounted in the receiving hole of the driving portion of the control knob and is urged on the inner side of a respective one of the two pawl members; and the elastic member is mounted in the receiving hole of the driving portion of the control knob and is urged between the two positioning members.

7. The quick rotation wrench having an angle adjustment structure in accordance with claim 6, wherein the inner side of each of the two pawl members is formed with a positioning cavity, and each of the two positioning members is urged in the positioning cavity of a respective one of the two pawl members.

8. The quick rotation wrench having an angle adjustment structure in accordance with claim 1, further comprising an urging member mounted in the receiving chamber of the shaft seat of the wrench body and urged on the bottom of the driving portion of the control knob.

9. The quick rotation wrench having an angle adjustment structure in accordance with claim 8, further comprising an elastic member mounted in the receiving chamber of the shaft seat of the wrench body and urged between a wall of the receiving chamber of the shaft seat of the wrench body and the urging member.

10. The quick rotation wrench having an angle adjustment structure in accordance with claim 1, wherein the driving portion is formed with an insertion recess for insertion of a spanner.

11. The quick rotation wrench having an angle adjustment structure in accordance with claim 10, wherein the driving portion has a wall formed with a ball hole communicating with the insertion recess for receiving a positioning ball and an elastic member which is urged on the spanner.

* * * * *